US006398477B1

(12) United States Patent
Fox

(10) Patent No.: US 6,398,477 B1
(45) Date of Patent: Jun. 4, 2002

(54) ELECTRIC HAND TRUCK

(76) Inventor: Anthony Fox, 8306 Queen Ave. South, Bloomington, MN (US) 55431

( * ) Notice: Subject to any disclaimer, the term of this patent is extended or adjusted under 35 U.S.C. 154(b) by 0 days.

(21) Appl. No.: 09/543,687

(22) Filed: Apr. 5, 2000

Related U.S. Application Data

(60) Provisional application No. 60/137,832, filed on Jun. 7, 1999.

(51) Int. Cl.[7] ..... B66F 9/75
(52) U.S. Cl. ..... 414/490
(58) Field of Search ..... 414/490; 187/230, 187/238

(56) References Cited

U.S. PATENT DOCUMENTS

| | | | | |
|---|---|---|---|---|
| 3,841,442 A | * | 10/1974 | Erickson et al. | 187/9 X |
| 4,034,878 A | | 7/1977 | Fox | 214/374 |
| 4,441,849 A | * | 4/1984 | Dazmang | 414/490 |
| 4,737,065 A | * | 4/1988 | Ju | 414/490 |
| 4,981,412 A | * | 1/1991 | Hawkins | 414/490 |
| 5,082,090 A | * | 1/1992 | Walker | 187/9 X |
| 5,251,922 A | * | 10/1993 | Mann | 280/47.29 X |
| 5,707,200 A | * | 1/1998 | Liu | 414/490 |
| 5,839,851 A | * | 11/1998 | Norfolk et al. | 405/3 X |
| 5,885,047 A | * | 3/1999 | Davis et al. | 414/490 |

FOREIGN PATENT DOCUMENTS

| | | | | |
|---|---|---|---|---|
| CH | 664 146 A1 | * | 2/1988 | B66F/9/075 |

* cited by examiner

*Primary Examiner*—Christopher P. Ellis
*Assistant Examiner*—Kenneth W Bower
(74) *Attorney, Agent, or Firm*—Nikolai & Mersereau, P.A.

(57) ABSTRACT

An electric hand truck having positive and negative lift capability. The hand truck can lower objects from stairs, loading docks, or trucks. The hand truck can also lift objects from the floor upward and climb stairs. It has a platform with caster wheels for easy of mobility in tight places. It has brakes and an adjustable tilt with a dolly such that the cargo hauled can be wheeled on the hand trucks main wheels and on the dolly wheels which support the object at an angle. The objects are raised or lowered by an electric motor run on a battery. The switch for the motor is a strip switch running the length of the rail extrusions for ease of access. The hand truck is lightweight and maneuverable. The dolly tilts the rail extrusions are easily adjustable angles to suit the load. Handles attached to the rail extrusions make the hand truck easy to maneuver.

7 Claims, 2 Drawing Sheets

ELECTRIC HAND TRUCK

This application claims benefit of Provisional No. 60/137,832, filed Jun. 7, 1999.

BACKGROUND OF THE INVENTION

I. Field of the Invention

This invention relates generally to hand trucks for moving heavy loads, and more particularly, to an electric motor powered hand truck for raising and lowering heavy loads, that hand truck being designed to be highly maneuverable when either loaded or unloaded by a single operator.

II. Discussion of the Prior Art

The closest prior art which I am aware is my own earlier electric hand truck described in U.S. Pat. No. 4,034,878, the teachings of which are hereby incorporated by reference. The present invention is considered to be a marked improvement over the product corresponding to my '878 patent. Specific features considered to be improvements include, but are not limited to:

1. My new hand truck provides for both negative and positive lifting of a load. That is to say, with the floor as a reference, the hand truck of the present invention is capable of not only lowering a load below floor level, for example, at a loading dock, but is also capable of elevating the load above the floor as with a fork lift. It also has the ability to climb stairs and get into a truck with a full load on it.

2. My new design is of lighter weight construction, without a sacrifice in strength or load carrying capability. This is achieved by utilizing inner and outer side rails comprising aluminum extrusions for the vertical frame members, where the extrusions are designed to interlock, yet slide relative to one another without binding.

3. Improved mobility of the unit is assured by providing a plurality of swivel casters on the underside of the main load plate which attaches to the inner side rail extrusions of the vertical frame members and with the hand cart's main wheels journaled for rotation on a main frame casting that is affixed to the outer side rails of the left and right interlocking extrusions forming the vertical frame members.

4. Load bearing forks are pivotally mounted on the main frame casting and when lowered parallel to the ground, they straddle the load plate. The pivotal load arms are deployed when taking advantage of the positive lift feature of the hand cart, but are swung up and out of the way when utilizing the negative drop feature.

5. A motor driven lead screw is operatively coupled between the main frame casting and a top member spanning and affixed to the outer side rail extrusions and the lead screw cooperates with a traveling nut mounted on a top plate spanning the inner side rail extrusions. Thus, as the electric motor drives the lead screw, the inner and outer side rail extrusions are longitudinally displaced relative to one another in a direction depending upon the direction of rotation of the motor.

6. The interlocking side rail extrusions include longitudinal grooves extending the length thereof for permitting the attachment of a stabilizing carriage frame that is supported in a cantilevered dolly fashion toward the rear of the hand truck and which also has swivel caster wheels affixed to the underside thereof for engaging the ground when the hand truck is tilted back at an angle to the vertical. The slots in the side rail extrusions also permit flexible cinch belts to be used to secure a load onto the handcart.

7. The use of elongated lineal contact electrical switch strips mounted on the outer one of each of the extruded side rails makes it easy for an operator to control energization of the motor from a point anywhere along the side rails, thus obviating the need to search for a small on/off switch as in the prior art.

DESCRIPTION OF THE DRAWINGS

Other features, objects and advantages of the invention will become apparent to those skilled in the art from the following detailed description of a preferred embodiment, especially when considered in conjunction with the accompanying drawings in which.

DESCRIPTION OF THE PREFERRED EMBODIMENT

Figure 1:
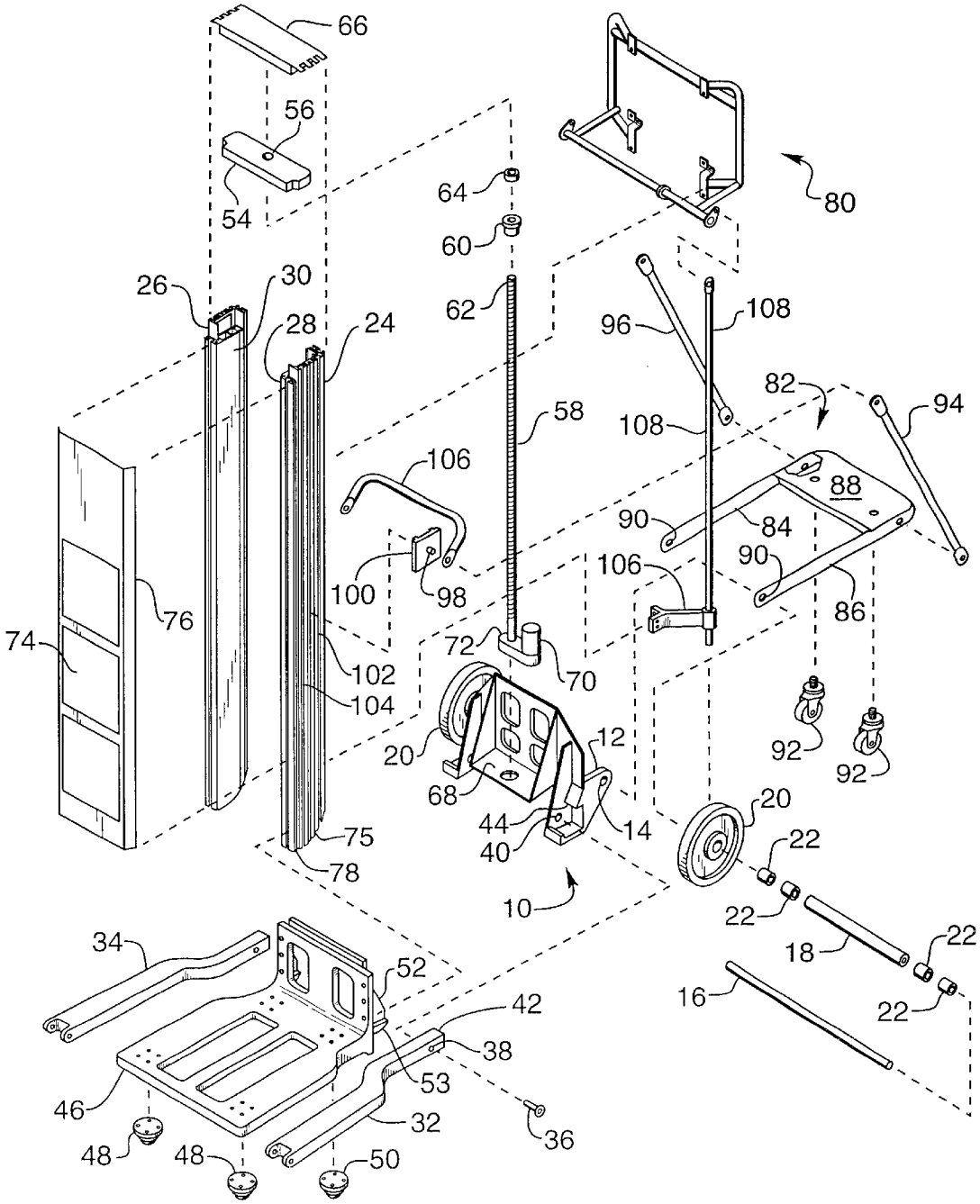
FIG. 1 is an exploded view of the handcart constructed in accordance with the present invention.

Referring to FIG. 1, the motorized hand truck of the present invention is seen to comprise a main casting 10 which is preferably fabricated from aluminum or another lightweight, yet strong, material. The main casting has rearward projecting ears 12 on a opposed sides thereof and extending through each of the ears is a bore 14 for receiving an axle assembly therethrough. The axle assembly is seen to comprise a main wheel shaft 16 and fitted over the shaft 16 is a tubular axle member 18. A pair of wheels, as at 20, are journaled for rotation on the shaft 16 by means of sleeve bearings 22. The main wheel casting 10 is bolted to the rear edge surfaces of outer side rail extrusions 24 and 26 which telescopingly fit about inner side rail extrusions 28 and 30. Nylon pads 31 and 33 (FIG. 2) are positioned between mating surfaces of the interlocking side rails to provide a relatively low friction contact, thereby facilitating the ability of the inner and outer side rails to slide relative to one another. When assembled together, the surface 35 of the inner rails 28 and 30 abuts the pad 33 having a low coefficient of friction while surface 37 of the outer frame rail extrusions 24 and 26 rides on the Nylon paid 31.

Pivotally joined to the main casting 10 is a pair of load arms 32 and 34. More specifically, a hinge pin, as at 36, passes through a bore 38 formed in each of the load arms 32 and 34 with the pin fitting into a threaded bore 40 formed in the main frame casting 10. When the arms 32 and 34 are lowered parallel to the ground, a rear end portion 42 thereof engages a projection 44 on the casting to prevent further counterclockwise rotation past the horizontal. The arms 32 and 34, however, can be rotated in the clockwise direction to a vertical orientation straddling the left and right side rails.

Figure 2:
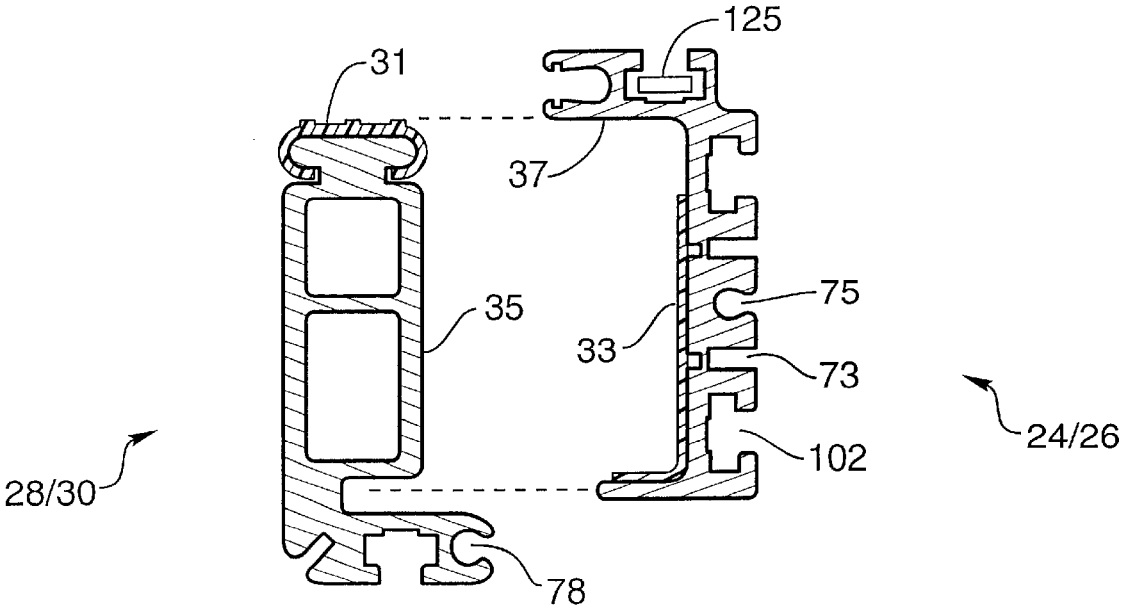
FIG. 2 is an exploded, cross-sectional view of the inner and outer side rail extrusions.
Figure 3:
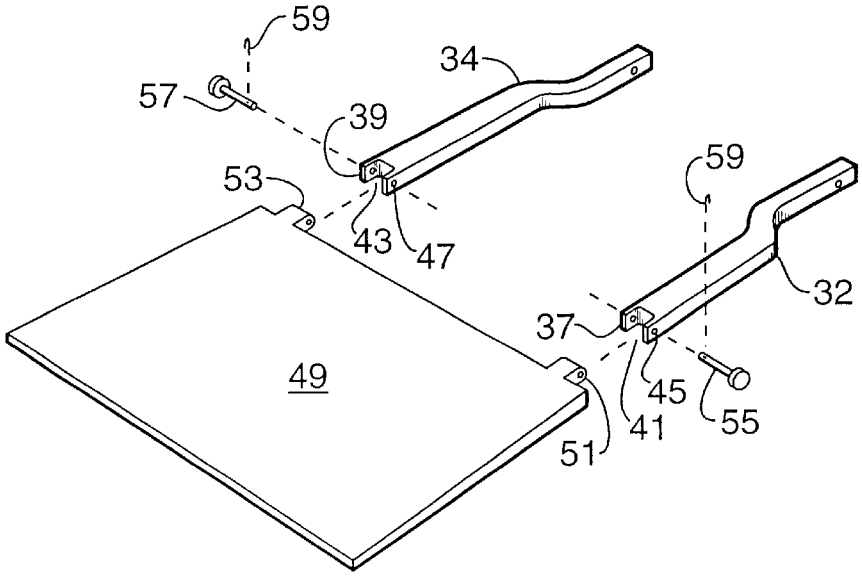
FIG. 3 is an exploded partial perspective view of the load arms showing how an optional dump plate may be attached.

As seen in FIGS. 2 and 3, the outer ends 37 and 39 of the load arms 32 and 34 are bifurcated to define a slot 41 and 43 therein and a bore 45 and 47 extends across the notch as best seen in FIG. 3. An optional dump plate 49 includes lugs 51 and 53 also having a transverse bore extending therethrough are adapted to fit between the tines defining the notches 41 and 43 to be held in place by clevis pins 55 and 57 and spring clips 59.

Bolted to the inner rails 28 and 30 proximate the lower end thereof is a load plate member 46, preferably formed from cast aluminum. Bolted to the undersurface of the plate 46 are front and rear caster pairs 48 and 50. A further pair of wheels (not shown) are mounted on an axle that extend between gusset members 52 that are integral with the load plate 46. These wheels, being of a relatively small diameter as compared to the main wheels 20, function as a fulcrum dolly when the hand cart is tipped to a rearward disposition when the main wheels happen to be elevated, all as will be further explained. The lower rear edge 53 of the gussets 52 on the load plate member 46 are formed in a radius of about 3 inches over an arc of about 60°, which, as will be explained, comes into play when manipulating the hand truck to climb stairs.

An inner top plate 54 extends between and bolts to the inner pair of side rail extrusions 28 and 30 and formed through the thickness dimension of the top plate 54 is a bore 56 which is adapted to receive an upper portion of an elongated lead screw 58 therethrough. Affixed to the undersurface of the top plate 54 is a traveling ball screw 60. The upper end 62 of the lead screw 58 is journaled for rotation in a bearing 64 that fits into a bore (not shown) formed on the undersurface of a top plate member 66 that spans between and attaches to the upper end of the outer side rail extrusions 24 and 26. A lower end of the lead screw 58 is journaled for rotation in a bearing mounted centrally in a base portion 68 of the main frame casting 10.

A DC drive motor 70 is coupled through a clutch assembly 72 to the lead screw 58. The motor and clutch are of a type manufactured and sold by Warner Ballscrew Corporation of Chicago, Ill., and is designed to rotate the lead screw 58 when carrying a predetermined weight. The clutch will slip if the weight limit is exceeded, preventing the load from being raised or lowered. A two-speed motor may also be used. When a light load is involved, it can be in the high-speed mode, but when heavily loaded, the motor may run at a low speed, high torque mode. A battery, preferably a rechargeable lead-acid type battery (not shown) mounts on the platform 68 of the main frame member 10 and is connected through an elongated strip switch (not shown) snaps into a groove 73 that runs the length of the side rails 24 and 26.

A front screen panel 74 has side flanges 76 on opposed side edges thereof that are adapted to fit into longitudinal grooves, as at 78, formed in the front edge of the inner side rail extrusions to prevent accidental contact with the motor driven lead screw.

A handle assembly, indicated generally by numeral 80, attaches to the rear edge surface of the outer side rail extrusions 24 and 26, which handles can be readily grasped by the operator for tilting the hand truck to the rear and for steering the hand truck as it is being pushed along the ground.

A stabilizing platform assembly is pivotally mounted to the main frame casting 10 and includes a pair of arms 84 and 86 that are maintained in parallel, spaced-apart relationship by a transversely extending plate 88. The arms 84 and 86 each include a bore as at 90 extending therethrough such that the main wheel shaft 16 may pass through the apertures 90, allowing rotation of the stabilizer carriage assembly 82 about the shaft 16. The stabilizer carriage assembly also includes a pair of swivel caster wheels 92 which fasten to the undersurface of the plate 88 to engage the ground when the stabilizer assembly 82 is in its lowered disposition. Completing the stabilizer carriage assembly 82 are a pair of guide rods 94 and 96 which are pivotally joined to the outer ends of the arms 84 and 86, as illustrated, and the upper ends of the guide rods 94 and 96 have apertures therethrough for fitting about studs, as at 98 that project from locking plates 100 that cooperate with grooves 102 and 104 formed vertically in the outer guide rail extrusions 24 and 26. A handle 106 when rotated clockwise rotates the studs 98 into engagement with the outer side rails to prevent the slidable locking plates 100 from moving vertically. When the locking 106 is rotated counterclockwise, the studs are loosened to the point where the plates 100 can slide in their associated T-slots, allowing the stabilizer assembly 82 to be raised or lowered relative to the ground.

To prevent unwanted movement of the handcart, a break assembly is provided that cooperates with the wheels 20 to prevent their rotation. Specifically, coupled to the handle bar assembly 80, and passing through a guide bracket 116, is a steel rod 108 whose upper end attaches to the handle assembly 80. The lower end of the rod 108 normally rides above the rubber surface of the wheels 20, but when the handle bar is lowered, the lower end of the rod 108 presses securely against the wheels 20 to prevent their rotation. While a particular brake arrangements illustrated, other such braking devices can be substituted without departing from my invention.

OPERATION

When making a delivery of a household appliance, such as a refrigerator, the deliveryman will first raise the load arms 32 and 34 so that they are out of the way and then the load will be tipped such that the load plate 46 can be slipped under the appliance or its box or container. A cinch strap is then placed about the load and its ends are locked into slots, as at 75, formed in the extrusions 24 and 26. By pulling rearward on the handle assembly 80, the handcart and load becomes supported on the wheels 20. Now, by lowering the stabilizer assembly 82 and retightening the studs 98, further rotation of the handcart and load is prevented. The delivery person may now readily push the handcart with its load from a loading dock into a waiting delivery truck. It has been found expedient to locate a rearward-facing recessed, pop-up hook on the loading dock and in the delivery truck bed to act as a deployable stop to prevent the motorized hand truck from unintentionally going over the edge of the dock or truck tail gate. The hook is dimensioned to engage the plate 88 of the stabilizer assembly before the wheels of the handcart reach the dock's edge or the tailgate's edge.

If the delivery truck is heavily loaded, it may be necessary to position the handcart with the load attached into a confined space. This can readily be done by returning the handcart to its vertical orientation and then actuating the lead screw drive motor to raise the outer rails and the main frame casting 10 so that the wheels 20 no longer contact the ground. The load will then be supported on the caster wheels 48 and 50, allowing the load to be readily translated and rotated until it fits within the confined space.

Upon reaching the home site where the appliance is to be delivered, the delivery person will maneuver the handcart until the guide rail extrusions extend beyond the end of the tailgate of the delivery vehicle. At this point, the handle 80 will be manipulated to bring the locking rods 108 into engagement with the tires on the wheels 20. Now, by actuating one of the two switch strips, the lead screw can be driven in a direction to lower the load plate carrying the appliance until the caster wheels 48 and 50 on the underside of the load plate contact the ground. At this point, the main frame casting 10 supporting the wheels 20 will be still at the level of the delivery truck's tailgate. In a prototype machine built in accordance with the present invention, it is possible to displace the load plate 46, 52" below the level of the wheels 20.

Next, by releasing the brake and pushing the hand cart a few inches forward as it rides on the caster wheels 48 and 50, the motor 70 can be made to rotate the screw 58 in a direction to lower the main frame casting 10 and the wheels 20 to ground level by pressing anywhere along the length of the other of the two lineal contact switch strips.

By pulling back on the handle assembly 80, the load can again be tipped rearward and the stabilizing platform 88 may also be lowered to bring its caster wheels 92 into contact with the ground. Here, the delivery person may now push the cart and load to the entry steps of the home where the delivery is to be made.

By sequentially raising and lowering the wheels 20, tipping back the hand cart, elevating the load, returning the hand cart to the vertical and repeating these maneuvers, the hand cart can be made to "climb" stairs leading to the home's entrance door. Once through the doors, the appliance on the handcart can be wheeled to the area of the home where the appliance is to be installed. In moving a load down a flight of stairs, the knurled radiused surface 53 of the load plate engages the steps as a load is being lowered on the motorized hand truck, preventing the handcart from sliding relative to the stairs.

In other applications, it may be desirable to elevate a load to a point above the ground. Here, the load arms 32 and 34 will be rotated to their horizontal position and the load placed on them. Again, by squeezing the appropriate switch strip that extends along the rear edge of the outer side frame extrusion, the motor will be energized to rotate the lead screw in a direction to raise the top plate 66 affixed to the outer side rails and thereby lifting the main frame casting 10 and the load bearing arms 32 and 34 vertically upwards.

This feature can advantageously be used by a workman installing sheetrock ceiling panels. A sheetrock panel may be placed horizontally atop the cover plate 66 and the workman may stand on the load arms 32 and 34. Actuation of the motor then causes the lead screw to elevate both the sheetrock panel and the workmen until the sheetrock panel is at ceiling height. The workmen may now use conventional sheetrock screws to secure the ceiling panel in place on the undersurface of the ceiling joists of the building.

When using the electric hand truck of the present invention to transport baled waste from a compactor to a dumpster, the optional dump plate 49 shown in FIG. 3 can advantageously be used. Here, the plate 49 will be rotated about the clevis pins 55 and 57 so as to lay atop the load arms 32 and 34. A box or a bale ejected from the compactor will sit on and be supported by the dump plate 49 when the load arms 32 and 34 rest on the ground. Once the load is in place on the dump plate, the lineal switch used to energize the motor to raise the load arms 32 and 34 is actuated and the hand truck may be tilted back with the stabilizer assembly deployed, allowing a person to easily push the hand cart to the location of a dumpster where the bale of waste is to be deposited. At this point, the hand cart will be returned to its vertical orientation supported by the caster wheels 48 and 50 on the bottom of the load plate close to a side of the dumpster. The motorized lead screw will again be actuated with the operation of the lineal switch associated with the raising of the load 32 and 34, causing the bale of waste resting on the dump plate to be elevated to a level just above the upper rim of the dumpster. Now, the handcart can be moved on its caster wheels until the load is cantilevered over the open top of the dumpster. At this point, the operator will manually rotate the dump plate in a counterclockwise direction when viewed as in FIG. 3 until the load slides off of the dump plate into the open dumpster.

I claim:

1. An electric hand truck comprising:

a casting, a pair of outer rail extrusions attached to the casting one rail extrusion on either side of the casting, a pair of inner rail extrusions, one slidably attached to the outer rail extrusions, a pair of load arms pivotally attached to the casting such that the load arms can move between parallel and perpendicular positions relative to the outer rail extrusions, a load plate attached perpendicularly to the lower end of the inner rail extensions for carrying a load, the load plate fitting between the load arms, a means for moving the inner rail extrusions relative to the outer rail extrusions such that the load plate rests on the ground and with the load arms parallel to the load plate the load arms move upward to raise objects from the ground or lower objects to the ground, and with the load arms perpendicular to the load plate and the casing bearing the weight of the hand truck on a support surface the object can be lowered below the casing.

2. An electric hand truck as in claim 1 wherein, wheels are rotatably attached to the casing such that the hand truck can be wheeled around.

3. An electric hand truck as in claim 2 wherein, a stabilizing platform is pivotally attached to the casing, a pair of arms one arm on each side of the platform and pivotally connected thereto, the arms extending to and are slidable connect the outer rail extrusions such that the stabilizing platform is adjustably angled with respect to the outer rail extrusions thus tilting the outer rail extrusions to tilt the object over the stabilizing platform, a pair of wheels under the stabilizing platform opposite the wheels on the casing such that the object can be wheeled around on the hand truck with the object angled over the stabilizing platform.

4. An electric hand truck as in claim 2 wherein, the means for moving the inner rail extrusions relative to the outer rail extrusions includes an electric motor and a battery, and wherein there is a strip switch along the outer rail extrusion such that the switch can be easily engaged no matter what the height of the outer rail extrusion relative to the ground.

5. An electric hand truck as in claim 2 wherein, a brake engages the wheels on the casing to prevent movement of the electric hand truck.

6. An electric hand truck as in claim 2 wherein, handles attached to the outer rail extrusion allow gripping for easily pushing pulling or turning the electric hand truck.

7. An electric hand truck as in claim 2 wherein, the means for moving the inner rail extrusions relative to the outer rail extrusions includes a screw rod rotatably connected to the casing and to a top casing attached to the outer rail extrusions, and an inner casing attached to the inner rail extrusions, the inner casing moveably connected to and moved by the screw rod as it rotates.

* * * * *